US011407614B2

(12) United States Patent
Onat et al.

(10) Patent No.: US 11,407,614 B2
(45) Date of Patent: Aug. 9, 2022

(54) NONLINEAR AND EFFICIENT EDDY-CURRENT OVERSPEED PROTECTION SYSTEM FOR ELEVATORS

(71) Applicant: SABANCI UNIVERSITESI, Istanbul (TR)

(72) Inventors: Ahmet Onat, Istanbul (TR); Sandor Markon, Kobe (JP)

(73) Assignee: SABANCI UNIVERSITESI, Istanbul (TR)

( * ) Notice: Subject to any disclaimer, the term of this patent is extended or adjusted under 35 U.S.C. 154(b) by 332 days.

(21) Appl. No.: 16/491,577

(22) PCT Filed: Mar. 8, 2017

(86) PCT No.: PCT/TR2017/050088
§ 371 (c)(1),
(2) Date: Sep. 6, 2019

(87) PCT Pub. No.: WO2018/164649
PCT Pub. Date: Sep. 13, 2018

(65) Prior Publication Data

US 2021/0139278 A1 May 13, 2021

(51) Int. Cl.
*B66B 5/04* (2006.01)
*B66B 5/16* (2006.01)

(52) U.S. Cl.
CPC . *B66B 5/04* (2013.01); *B66B 5/16* (2013.01)

(58) Field of Classification Search
CPC .. B66B 5/04; B66B 5/16; B66B 5/044; B66B 5/046
See application file for complete search history.

(56) References Cited

U.S. PATENT DOCUMENTS 5,366,044 A 11/1994 Jamieson et al.
5,628,385 A 5/1997 Yumura et al.
(Continued)

FOREIGN PATENT DOCUMENTS

JP H05147852 A * 6/1993 ..... B66B 5/044
JP H11242044 A * 9/1999 ..... B66B 5/044
(Continued)

*Primary Examiner* — Michael R Mansen
*Assistant Examiner* — Michelle M Lantrip
(74) *Attorney, Agent, or Firm* — Bayramoglu Law Offices LLC

(57) ABSTRACT

An overspeed emergency brake system includes an overspeed detector magnet generating a brake actuation force and a kinematic constraint element guiding the movement of the magnet. The magnet and a kinematic constraint element in the brake system are arranged such that a linear brake actuation force is generated at a normal operating speed condition (i.e in a first position of the magnet with respect to the kinematic constraint element), due to the movement of the kinematic constraint element when guiding the magnet along a reaction surface and the kinematic constraint element converts the linear speed-force relationship into a nonlinear speed-force relationship in an overspeed condition (i.e a second position), while the magnet translates with respect to the kinematic constraint element generating a sharply increasing force for triggering the overspeed emergency brake.

19 Claims, 7 Drawing Sheets

(56) References Cited

U.S. PATENT DOCUMENTS

| | | | | | |
|---|---|---|---|---|---|
| 6,161,653 | A * | 12/2000 | Skalski | B66B 5/04 | 187/373 |
| 6,227,334 | B1 * | 5/2001 | Yumura | B66B 5/048 | 187/373 |
| 6,523,650 | B1 * | 2/2003 | Pribonic | B60L 7/28 | 188/165 |
| 6,659,237 | B1 * | 12/2003 | Pribonic | B60L 7/28 | 188/165 |
| 10,662,029 | B2 * | 5/2020 | Vakkamaki | B66B 1/32 | |
| 2020/0055695 | A1 * | 2/2020 | Inoue | B66B 3/02 | |

FOREIGN PATENT DOCUMENTS

| | | | | | |
|---|---|---|---|---|---|
| JP | H11349250 | A * | 12/1999 | B66B 5/044 | |
| JP | 2000007245 | A * | 1/2000 | B66B 5/044 | |
| JP | 2000211840 | A | 8/2000 | | |
| JP | 2003137482 | A * | 5/2003 | B66B 5/044 | |
| JP | 2006131423 | A * | 5/2006 | B66B 5/044 | |
| WO | WO-2012011903 | A1 * | 1/2012 | B66B 5/06 | |

* cited by examiner

NONLINEAR AND EFFICIENT EDDY-CURRENT OVERSPEED PROTECTION SYSTEM FOR ELEVATORS

CROSS REFERENCE TO THE RELATED APPLICATIONS

This application is the national phase entry of International Application No. PCT/TR 2017/050088, filed on Mar. 8, 2017, the entire contents of which are incorporated herein by reference.

TECHNICAL FIELD

The invention is related to the use of nonlinear eddy-currents in the precise detection of overspeed and actuation of overspeed emergency brake for elevators and other vertical transport systems.

BACKGROUND

Several safety devices must be installed in elevator systems for the safety of the passengers in passenger carrying elevators as dictated by law, such as limit switches, floor position sensors, overspeed sensors, door safety sensors etc. Some of these may be electromechanical, and others purely mechanical, but generally they must work independently of other systems of the elevator.

One of the important safety devices in the elevator system are the overspeed sensors which detect whether the elevator is exceeding design speeds in the up or down direction. Overspeed may be caused because of malfunctioning motor or motor controllers, severed traction cables, software fault or similar. In case the overspeed condition is detected, an independent brake mechanism must be triggered which must arrest the motion of the elevator car, typically by grabbing the guide rails. These will be called overspeed emergency detectors and actuators.

The conventional overspeed detection and actuation mechanism currently used in most elevators installed around the world is the cable-loop system which uses a traveling cable-loop stretched around pulleys at the top and bottom of the building and a mechanical nonlinear device which senses and restricts the speed of one of the pulleys, thus triggering an overspeed emergency brake attached to the elevator car. However, the cable-loop system that must span the height of the building is difficult and expensive to install and maintain as a safety device, especially for high-rise buildings. Multi-car elevator systems where several elevator cars operate in the same hoistway are unavoidable for the ultra high-rise buildings that are being planned and actively developed around the world. In multi-car elevator systems, the conventional safety mechanism which requires a separate cable-loop system for each elevator car is both technically difficult and takes up much room, making it impractical for general usage and limiting the number of cars that can be installed in the same hoistway.

In the state of art, a simplified drawing of a passenger elevator is shown in FIG. 1. Note the elevator car, traction cable, traction motor and counterweight. Guide rails are shown in the plan view (FIG. 2). The conventional overspeed detection system of FIG. 2, consists of a loop of cable tensioned between two pulleys stretched from the bottom of the hoistway to the top. One of the pulleys connects to a speed governor; a mechanical device with nonlinear speed-resistance torque relationship, which presents negligible force on the cable at normal speeds, but a high force above a pre-defined speed. The cable is attached through the overspeed emergency brake trigger, to the elevator car at the rope connection plate shown in FIG. 2 and moves at the same speed with it. In the overspeed condition, the speed governor exerts a high force to the cable, constraining its motion, and therefore causes the overspeed emergency brake to trigger and grab the guide rails, arresting the movement of the car. This should be an irreversible operation, once the brake is triggered, it cannot be released to resume normal operation.

In the state of the art in another application, in ultra high-rise buildings, rope-less elevators which are self-driven by linear motors are used for two main reasons:

1. To eliminate the traction cables pulling the elevator car. In slanted or very tall buildings, traction cables do not work as desired.

2. To implement the idea of multi-car elevators where several elevators run in the same hoistway to increase passenger traffic. Each elevator car in the hoistway would require a separate traction cable and be impractical. However, the same linear motor stator can be shared by several elevator cars. In the same perspective, it is also necessary to replace the cable-loop overspeed emergency brake system with another which does not require moving components outside the elevator car.

For these reasons, there is another overspeed emergency detection system which is called an eddy current overspeed detector, not widely used. In these applications it is better suited than the cable-loop system, because the moving components of the overspeed emergency brake system is completely self contained within the elevator car. The idea of generating force from eddy currents, called eddy current brakes, are based on the magnetic principle of Faraday's law of induction and Lenz's law, has been known for a long time, and is widely used as eddy current brakes used to slow down large masses from high speed, such as trains and trucks, without contact friction. It can be simply explained thus: When a magnetic gradient moves over a conductive (metal) plate, the changing magnetic flux induces eddy currents in the plate. The eddy currents in turn induce a magnetic flux, and due to the interaction with the original magnetic flux, a force appears in the opposite direction to the motion.

On the other hand, in the eddy current overspeed detector, a force generating head made of a magnet or magnetic circuit, which will be called "overspeed detector magnet", is movably attached to the elevator car and triggers the overspeed emergency brake mechanism and moves over a conductive surface which will be called the "reaction surface", that spans the height of the building. In an overspeed condition, the forces generated on the overspeed detector magnet are used to trigger the overspeed emergency brake mechanism. There is an important distinction between the eddy current brake and the eddy current overspeed detector. In the former, the braking force itself is obtained from the magnetic forces, whereas in the latter, the magnetic force is used to detect the overspeed condition.

One embodiment of this approach is disclosed in the patent document of U.S. Pat. No. 5,366,044, the general idea of using eddy currents to create a force that will trigger a mechanical overspeed emergency brake is disclosed. In this patent, a force that increases with the speed of the elevator is generated and the force is mechanically coupled to an overspeed emergency brake mechanism to trigger an overspeed emergency brake. The difference between the system proposed in this document is that the magnetic force increases proportionally (depending on the strength of the magnetic field and velocity), and this force always opposes the motion of the elevator. The disadvantages of this approach have been described as Problem 1 and Problem 2 below:

Problem 1:

A force opposite to the direction of motion and proportional in magnitude to velocity is constantly generated against the elevator movement and thus this system is inefficient in power consumption. In operating range of the device, the force is proportional; at extreme speeds the force will decrease. The eddy current overspeed protection systems previously disclosed have a problem of low power efficiency because these systems always apply a constant force proportional to the traveling velocity, opposing the movement of the elevator car.

Problem 2:

The generated force is proportional to the velocity of the elevator car which makes it difficult to set an exact overspeed velocity in which the overspeed emergency brake is triggered. Small manufacturing tolerances may cause proportionally higher overspeeds to go undetected, or cause the overspeed emergency brake to be triggered at low speeds. The linear relationship of the overspeed sensing force to the velocity of the elevator car makes it difficult to set a precise overspeed emergency braking speed. Due to manufacturing tolerances, the overspeed trigger velocity may differ from one implementation to another. This can cause dangerous situations where the overspeed braking is not initiated at the desired speed. Since the kinetic energy of the elevator car is related to the square of the speed, the emergency brake dissipation capacity may be exceeded and the elevator car may not be safely stopped.

In another patent document of U.S. Pat. No. 5,628,385 in the state of the art, the eddy current overspeed detection, similar to U.S. Pat. No. 5,366,044 is proposed. However, there is an attempt to improve its reliability over the latter, by implementing a linear spring and a nonlinear magnetic clutch to adjust when the overspeed action is triggered: A force due to eddy currents is generated. However, a magnetic clutch prevents displacements caused by the force. When the speed increases above a threshold, the magnetic clutch releases and the force becomes free to produce a displacement on the connection arm to actuate a mechanical overspeed emergency brake. Although this patent improves over U.S. Pat. No. 5,366,044 in that the brake trigger mechanism generates a displacement only at overspeed conditions, the speed set-point is not necessarily precise, and the opposing force proportional to speed still remains as a source of inefficiency.

SUMMARY

The aim of the invention is to propose a self-contained overspeed emergency brake sensing and trigger system for vertical transportation systems such as elevators which overcomes or reduces the problems of imprecise overspeed trigger velocity and low power efficiency. Another aim of the invention is to provide a practically useful overspeed emergency brake system which can be readily implemented with existing technologies. Because of its simple construction, the proposed overspeed emergency brake sensing and actuation system can replace the cable-loop mechanism of the contemporary elevators to reduce cost and complexity as well as linear motor driven elevators that are being actively developed.

The proposed invention is an enabling technology for the new generation multi-car elevator systems because the moving components of the system are completely contained within the elevator car itself. No mechanisms on the building are required.

In this invention, it is proposed an eddy-current overspeed emergency brake sensing and actuation system improved in two ways:

1. Power efficiency: During normal operation the power efficiency is high compared to other eddy current system and methods. During normal operation, the overspeed detector magnet only partially overlaps the reaction surface. Therefore, the generated forces that oppose the velocity (speed) of the elevator car are low.
2. Overspeed detection accuracy: The overspeed detector magnet swings towards and is mechanically guided to overlap the reaction surface more as the speed increases. This generates a nonlinear force on the brake trigger mechanism. By adjusting the kinematics of the system, the nonlinearity can be set precisely to occur at the pre-set speed value, therefore greatly enhancing the overspeed detection precision compared to previous systems.

Therefore the system is more compact, more efficient more reliable and more precise in an overspeed emergency condition when compared to existing eddy current overspeed detection and triggering systems used in elevators.

To accomplish the above purposes, the linear dependency between speed of the elevator and the magnet force must be reduced. In the applications of the prior art wherein the velocity-force relationship is linear, Problems 1 and 2 occur. However, in the invention the velocity-force relationship is non-linear where for operational velocities a low constant opposing force is generated (solving Problem 1) and just before the elevator reaches the overspeed trigger velocity the force rapidly increases (solving Problem 2). Mentioned velocity-force relationships of prior art and the invention are shown in FIG. 10, where D: Release from retracted limiting element E: Overspeed brake trigger velocity F: Restrained by extended limiting element The region in between D-F defines the transition region.

The system comprising magnet and kinematic constraint element, wherein magnet, and a kinematic constraint element are arranged such that a linear brake actuation force is generated at normal operating speeds of the elevator car, by moving the magnet along a reaction surface resulting a linear velocity-force relationship when the elevator car is in a normal operation speed condition, and the kinematic constraint element converts the linear speed-force relationship into a nonlinear speed-force relationship in an overspeed condition, thus keeping the mechanical losses low within the normal operating speeds, while generating a sharply increasing force in an overspeed condition.

DESCRIPTION OF THE REFERENCES IN THE FIGURES

Figure 1:
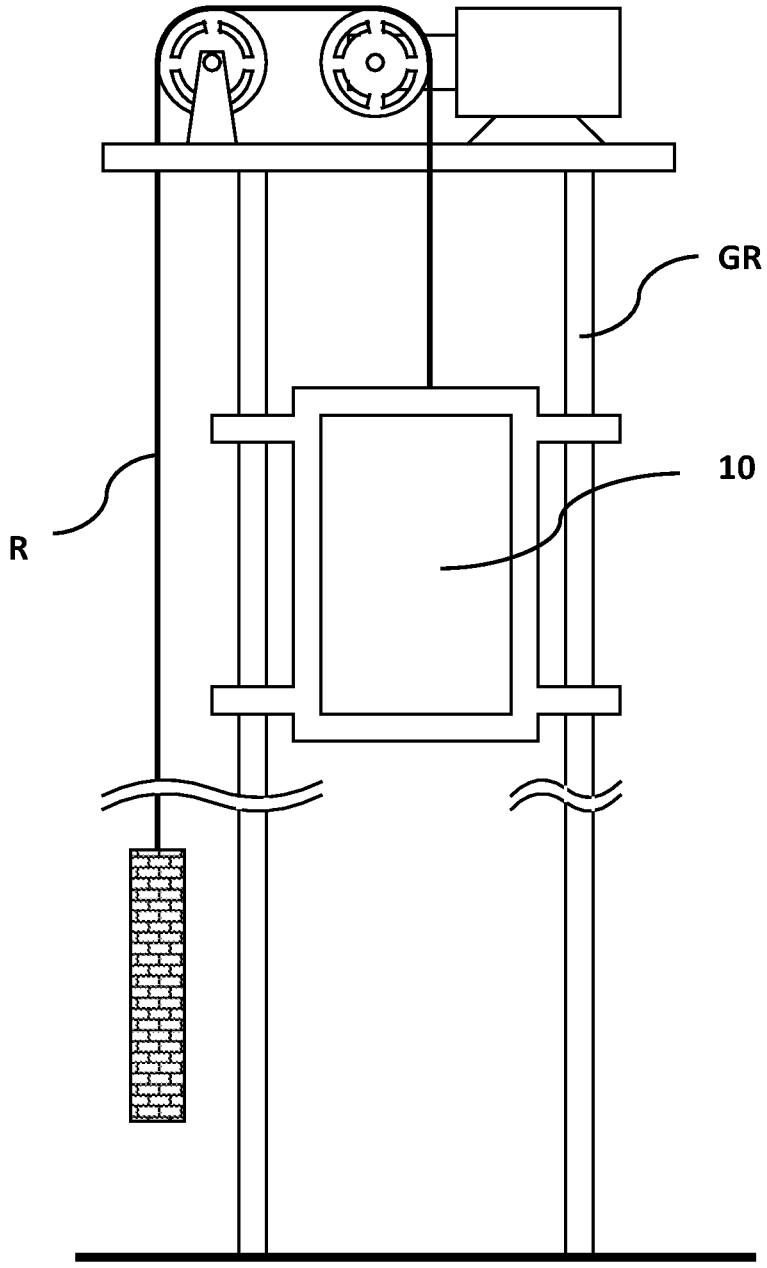
Fig. 1 (Prior Art)
FIG. 1 shows a schematic view of an elevator in the prior art.
Figure 2:
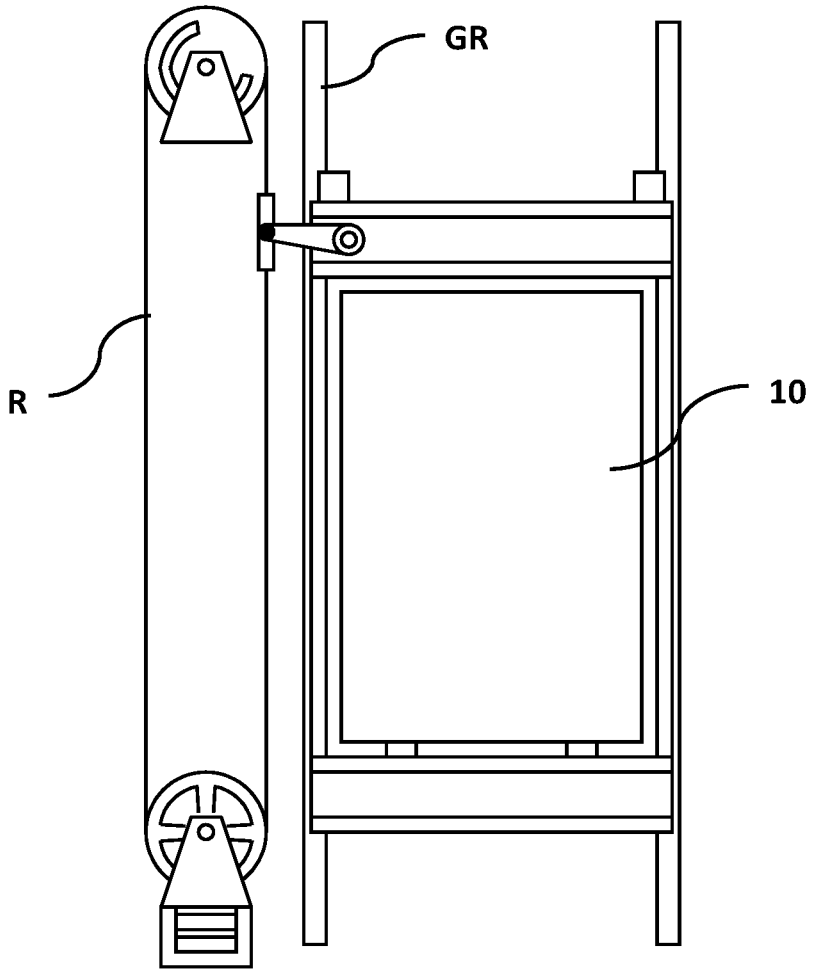
Fig. 2 (Prior Art)
FIG. 2 shows a schematic view of cable-loop overspeed governor for elevator in the prior art.

The elements illustrated in the figures are numbered as follows:

1—Brake system
- 10—Elevator car
  - 11—Magnet
- 21—Reaction surface
  - 21—Periodic feature
  - 211—Pitch
- 30—Kinematic constraint element
  - 31 Counterweight
  - 32 Controlling element
  - 33 Retracted limiting element
  - 34 Extended limiting element
  - 35 Pivot arm
  - 36 Parallel link
  - 37 Linear guide
- B. Overspeed emergency brake trigger
- R: Rope
- GR: Guide Rail
- MF. Magnetic force
- V. Elevator car velocity
- NV. Operational velocity of the elevator car
- OV. Overspeed velocity of the car

DETAILED DESCRIPTION OF THE EMBODIMENTS

Brake system (1) of the invention shall be understood as an overspeed emergency brake system (1).

The disclosed brake system (1) of the invention comprises a transport cabin such as an elevator car (10) having an overspeed detector magnet (11), a reaction surface (20) and a converting means (a kinematic constraint element (30)) to convert the velocity of the elevator car (10) with respect to the reaction surface (20) to the force on the magnet (11) in a nonlinear way.

A brake actuation force is generated by the magnet (11) moving along the reaction surface (20), where the force is linear in speed as long as the mechanical parameters are kept constant. Mechanical parameters are defined by: Position of the overspeed detector magnet (11) on a kinematic constraint element (30). A converting means converts the speed-linear force into a strongly nonlinear force, thus keeping the mechanical losses low within the operational velocity region (normal operating speed region), while generating a sharply increasing force when the speed reaches the the overspeed condition or increases above it.

The elevator car (10) has two operation conditions normal operating condition where the elevator car (10) travels at design velocities, and overspeed condition where the elevator car (10) exceeds design speeds. Magnet (11), reaction surface (20) and a kinematic constraint element (30) are arranged such that a linear brake actuation force is generated at normal operating speeds of the elevator car (10), by moving the magnet (11) along the reaction surface (20) resulting a linear velocity-force relationship when the elevator car (10) is in a normal operation speed condition, and the kinematic constraint element (30) converts the linear speed-force relationship into a nonlinear speed-force relationship in an overspeed condition, thus keeping the mechanical losses low within the normal operating speeds, while generating a sharply increasing force in an overspeed condition.

In normal operation conditions, the brake actuation force generated by the magnet (11) moving along the reaction surface (20) due to Lenz's law is kept small because the overlapping area between the magnet (11) and the reaction surface (20) is small or because the excitation rate of the periodic element is out of the resonant region of the kinematic constraint element (30) and the magnet (11). However as overspeed condition is neared, the force suddenly becomes larger. The nonlinear increase in the brake actuation force is provided by an increase of overlap area between the magnet (11) and the reaction surface (20) due to the kinematic constraint element (30), or resonance of the kinematic constraint element (30) due to modulation of the brake actuation force by a periodic feature (21).

Invention comprises two main embodiments. In one main embodiment, the mechanical nonlinearity is achieved by increasing the overlap of the magnet (11) with the reaction surface (20) with respect to the speed, by a kinematic constraint element (30) and a restraining force imposed by a controlling element (32).

In the second main embodiment, the mechanical nonlinearity is achieved by modulating the brake actuation force with a periodic feature (21) (for example periodically placed slots or equivalents) of the reaction surface (20), at the mechanical resonance of the kinematic constraint element (30) and the magnet (11).

The elevator car (10) comprises a kinematic constraint element (30) and the overspeed detector magnet (11). The elevator car (10) or the kinematic constraint element (30) may comprise a counterweight (31) according to the applications of the invention.

The kinematic constraint element (30) is attached to the elevator car (10) defining the motion trajectory of the overspeed detector magnet (11). The kinematic constraint element (30) may comprise or may be any mechanism which defines the motion of the magnet (11) with respect to the elevator car (10) and the reaction surface (20).

Controlling element (32) is a suitable mechanical retraction spring in the preferred embodiment, of linear or rotational design. It can also be another element which provides a constant force to keep the magnet (11) at a stable position of the kinematic constraint element (30) until a desired counter-force of sufficient magnitude occurs. In the applications of the invention, reaction surface (20) can be any appropriate reaction surface (20), for example, ferromagnetic or non-ferromagnetic. Typically the guide rail (GR) that is already installed in the hoistway for the elevator car (10) can be used or an extra surface can be installed for that purpose. In another embodiment of the invention, reaction surface (20) can be some other suitable component over which an overspeed detector magnet (11) moves.

Nonlinear velocity-force relationship is realized where at the overspeed condition the force on the magnet (11) is sharply increased due either to the design of the kinematic constraint, or a periodic feature (21) on the reaction surface (20).

When set-up of the system (1) to the elevator car (10) is finished, the kinematic constraint element (30) is attached to the elevator car (10).

The brake system (1) has several embodiments.

In some embodiments of the invention, the kinematic constraint element (30) is attached to the elevator car (10), one end is fixed to the overspeed detector magnet (11) and the other end is fixed to the controlling element (32). The kinematic constraint element (30) comprises a counterweight (31) to prevent motion of the overspeed detection magnet (11) under acceleration forces (FIGS. 3, 4, 5, 6 and 7). Therefore, the invention is sensitive to velocity rather than accelerations and false triggering of overspeed emergency brake is avoided, for example at startup and stopping of the elevator car (10).

In some embodiments of the invention, the kinematic constraint element (30) defines the motion trajectory of the overspeed detector magnet (11). Brake system (1) also comprises a retracted limiting element (33). Retracted limiting element (33) is a part of the kinematic constraint element (30) in an alternative. The controlling element (32) is attached in such a way that the overspeed detector magnet (11) is attracted towards the retracted limiting element (33) during operational velocity (normal operating speed) to minimize force during normal operating velocity. The brake system (1) further comprises an extended limiting element (34). Extended limiting element (34) is comprised by the kinematic constraint element (30) in an alternative. The extended limiting element (34) maintains maximum brake force and displacement of the overspeed detector magnet (11) at overspeed condition (FIGS. 3, 4, 6, 7, 8 and 9). Overspeed condition is used interchangeably with overspeed threshold limit or predefined overspeed limit or predetermined overspeed limit or pre-set overspeed limit or calibrated overspeed limit or pre-defined overspeed trigger velocity in this document. These expressions shall be read as the same meaning.

In another embodiment of the invention the kinematic constraint element (30) is defines the motion trajectory of the overspeed detector magnet (11). The controlling element (32) is attached in such a way that the overspeed detector magnet (11) overlaps the periodic feature (21) on the reaction surface (20) during normal operation velocity and is able to make oscillatory motion along the direction of motion of elevator car (10).

The first main embodiment of the invention, preferably the kinematic constraint element (30) comprises a pivot arm (35) or parallel link (36) or linear guide (37) as described below.

In the first main embodiment of the invention the essence of the operation is disclosed herewith: Under normal operation conditions the overlapping surface area of the overspeed detector magnet (11) and the reaction surface (20) is smaller than the surface area of the magnet (11), and a system must be provided such that the overlapping surface area increases with increased force.

Figure 3:
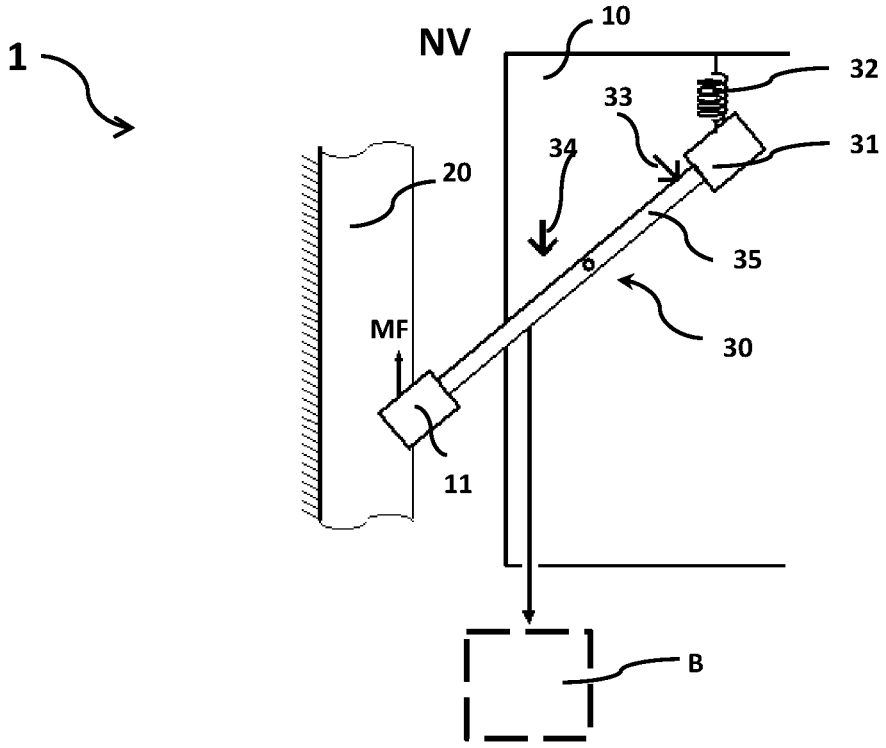
FIG. 3 shows a schematic view of the overspeed emergency brake system during operational velocity in one embodiment of the invention.
Figure 4:
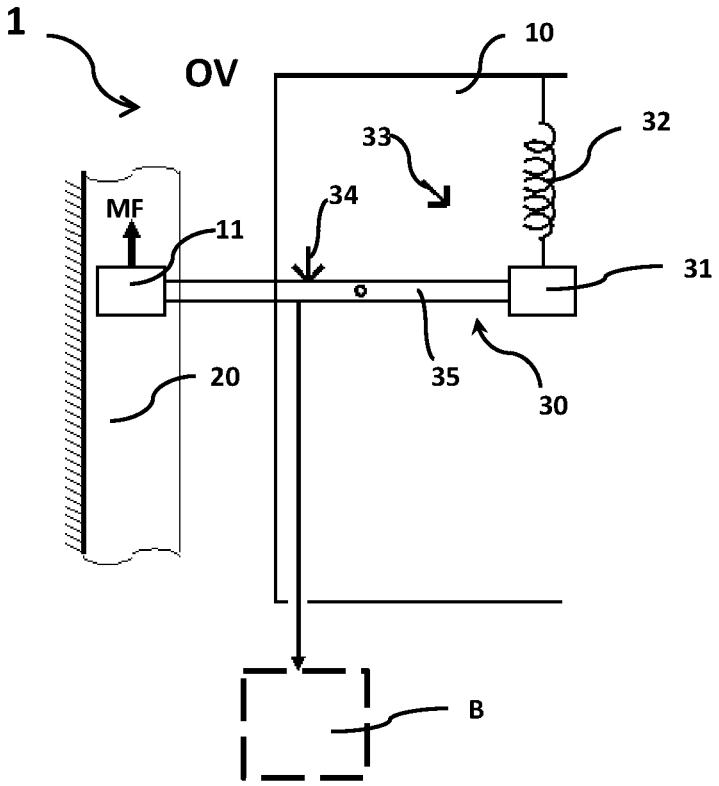
FIG. 4 shows a schematic view of the overspeed emergency brake system during overspeed for the embodiment of FIG. 3.

In the first alternative of the first main embodiment, the kinematic constraint element (30) is a pivot arm (35). In this embodiment, pivot arm (35) is fixed to the overspeed detector magnet (11) at one end and fixed to the controlling element (32) at the other end. After set-up of the system (1) to the elevator car (10) is finished, the end of the controlling element (32) which is not connected to the kinematic constraint element (30) is fixed to the elevator car (10) and the pivot point is attached to the elevator car (10). In this embodiment, the kinematic constraint element (30) comprises a counterweight (31) for countering the weight of the overspeed detector magnet (11) which serves to prevent acceleration forces from moving the overspeed detector magnet (11). In this embodiment system (1) comprises extended limiting element (34) and retracted limiting element (33). Retracted limiting element (33) causes pre-tension on the controlling element (32) and keeps the kinematic constraint element (30) at a resting position. Pivot arm (35) is connected with a suitable linkage having a specific mechanical advantage, to the trigger mechanism of the overspeed emergency brake (B), which is in turn, attached to the elevator car (10) (FIGS. 3 and 4).

Under normal operating conditions where the elevator car (10) moves within the operational velocity range, the kinematic constraint element (30) is held at its resting position due to the retracted limiting element (33) and controlling element (32), and the overspeed detector magnet (11) surface only partially overlaps the reaction surface (20). At the resting position, the force on the overspeed detector magnet (11) opposing the motion of the elevator car (10) due to Lenz's law is therefore small, and approximately linearly changes with the speed of the elevator car (10). This configuration is depicted in FIG. 3. Under normal operation conditions, the force generated on the overspeed detector magnet (11) is not sufficient to overcome the pre-tension on the controlling element (32) and the kinematic constraint element (30) remains at its resting position. The small overlap of the overspeed detector magnet (11) surface and reaction surface (20) at the resting position is the reason for the power efficiency of the invention (FIG. 3).

If the speed of the elevator car (10) increases, the force on the overspeed detector magnet (11) also increases. As the speed increases towards the overspeed set point, the force increases beyond the pre-tension force of the controlling element (32) and the overspeed detector magnet (11) begins to move restrained by the kinematic constraint element (30), increasing the overlap area between the overspeed detector magnet (11) and the reaction surface (20). This movement may be a rotational movement of the pivot arm (35). The increased overlap causes the force to increase in a vicious cycle, and thereby the kinematic constraint element (30) eventually swings up to the extended limiting element (34) where the overspeed detector magnet (11) fully overlaps the reaction surface (20) and generates the maximum force and displacement. The increased force on the overspeed detector magnet (11) and displacement of the kinematic constraint element (30) at the pre-defined overspeed trigger velocity is sufficient to trigger the emergency brake (B), thereby arresting the motion of the elevator car (10). The configuration of the brake system (1) at overspeed condition is shown in FIG. 4. This nonlinear increase in the magnetic force with increasing speed causes a sudden transition from the normal operating condition to the overspeed condition, which allows for good precision in setting the overspeed velocity.

In the second alternative of the first main embodiment (FIG. 6-7), kinematic constraint element (30) comprises a parallel link (36) i.e at least two parallel mechanical arms. In this embodiment, two mechanical arms and an overspeed detector magnet (11) is arranged such that the overspeed detector magnet (11) remains parallel to the reaction surface (20) on two mechanical arms during translation.

This embodiment operates with the same operation principle described in the first alternative of the first main embodiment wherein just the magnet (11) does not rotate with respect to the reaction surface (20) as it translates.

Figure 8:
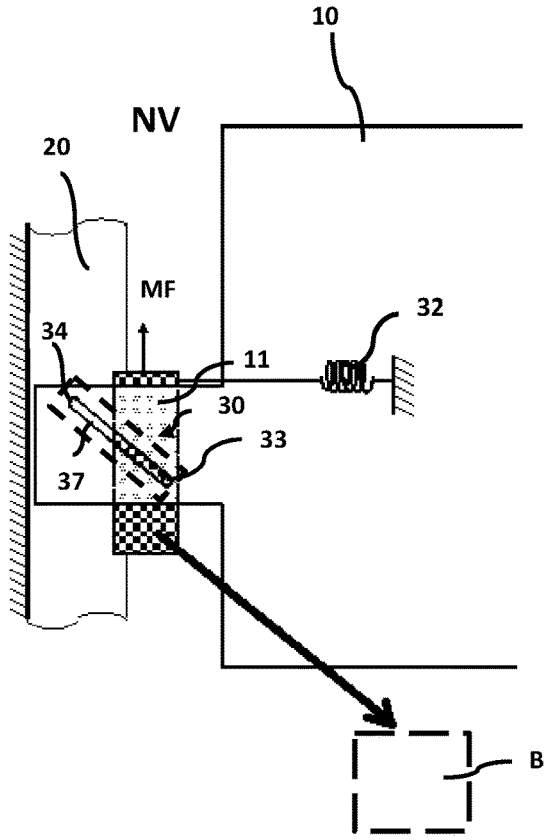
FIG. 8 shows a schematic view of the overspeed emergency brake system in another embodiment in operational velocity.
Figure 9:
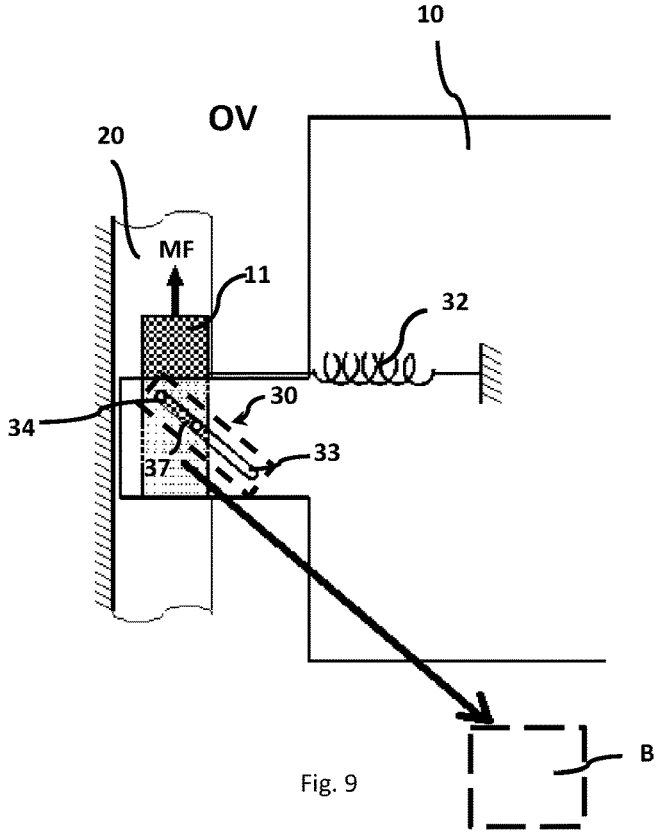
FIG. 9 shows a schematic view of the overspeed emergency brake system in the embodiment of FIG. 8 in overspeed operation.
Figure 10:
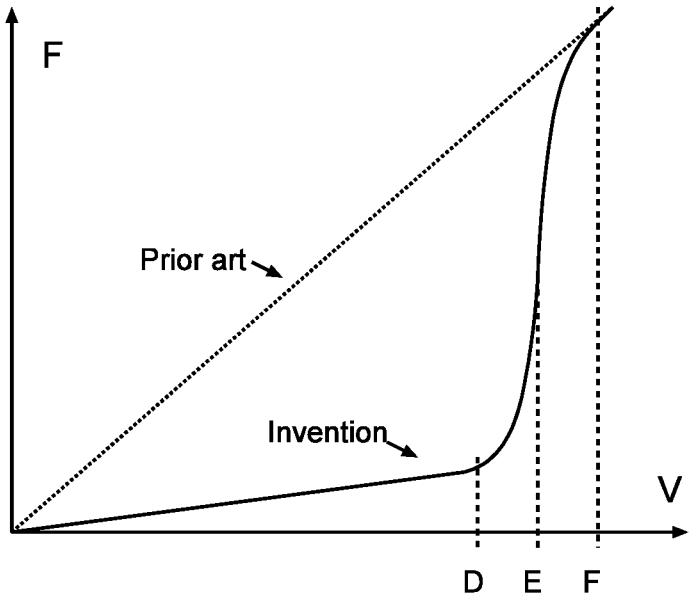
FIG. 10 shows a velocity-force relationship of an embodiment of the present invention as compared with that of the prior art.

A third alternative of the first main embodiment is illustrated in FIG. 8 and FIG. 9. This embodiment comprises a kinematic constraint element (30) consisting of at least one linear guide (37) (for example guide may comprise multitude of parallel guides). In this embodiment, the overspeed detector magnet (11) translates on a multitude of slanted parallel linear guides (37). These guides are attached to the elevator car (10) after set-up of the system (1) is realized on the elevator car (10). One movement limit of the linear guides (37) forms the retracted limiting element (33), and the other end is the extended limiting element (34). The overspeed detector magnet (11) is held towards the retracted limiting element (33) with suitable pre-tension using the controlling element (32), where its surface partially overlaps with the reaction surface (20). Linear guide (37) is connected with a suitable linkage having a specific mechanical advantage, to the trigger mechanism of the overspeed emergency brake (B), which is in turn, attached to the elevator car (10) (FIGS. 8 and 9). As overspeed condition is neared, the overspeed detector magnet (11) translates over the linear guides (37), and the overlapping surface between the overspeed detector magnet (11) and the reaction surface (20) increases. The principle of operation is the same as explained for the above disclosed embodiment of FIGS. 3, 4, 6 and 7).

The operation detailed so far is effective if the elevator car (10) overspeeds in the down direction. If the specific installation of an overspeed emergency brake, is requires for the elevator car (10) which overspeeds in the up direction (such as elevator cars (10) with a counterweight, a mechanism which is symmetrical around a horizontal line to that explained above, also needs to be implemented. A skilled person would be able to implement these symmetrical embodiments easily and these embodiments should be also regarded to be in the scope of the invention.

The kinematic constraint element (30) defining the movement of the overspeed detector magnet (11) during overspeed can be different as described above, as long as the essence of operation is the same.

The first main embodiment of the invention alleviates Problem-1 because during normal operation conditions, the overspeed detector magnet (11) only partially overlaps the reaction surface (20), which causes the opposing force on the overspeed detector magnet (11) to be greatly reduced. It alleviates Problem-2 because the proposed mechanism is activated by a positive feedback force at a given overspeed velocity whereas the force on the overspeed detector magnet (11) increases, the overspeed detector magnet (11) is constrained to move in a direction which increases the overlapping surface area between the overspeed detector magnet (11) and the reaction surface (20), which further increases the force. The structure of the system (1) including the kinematics, mechanical advantage, geometry and materials, determine the speed at which the trigger linkage will be activated. This can be calculated using normal engineering principles. The overspeed emergency brake (B) trigger mechanism and brake mechanism itself are conventional systems which can be used as is or with small modifications.

Figure 5:
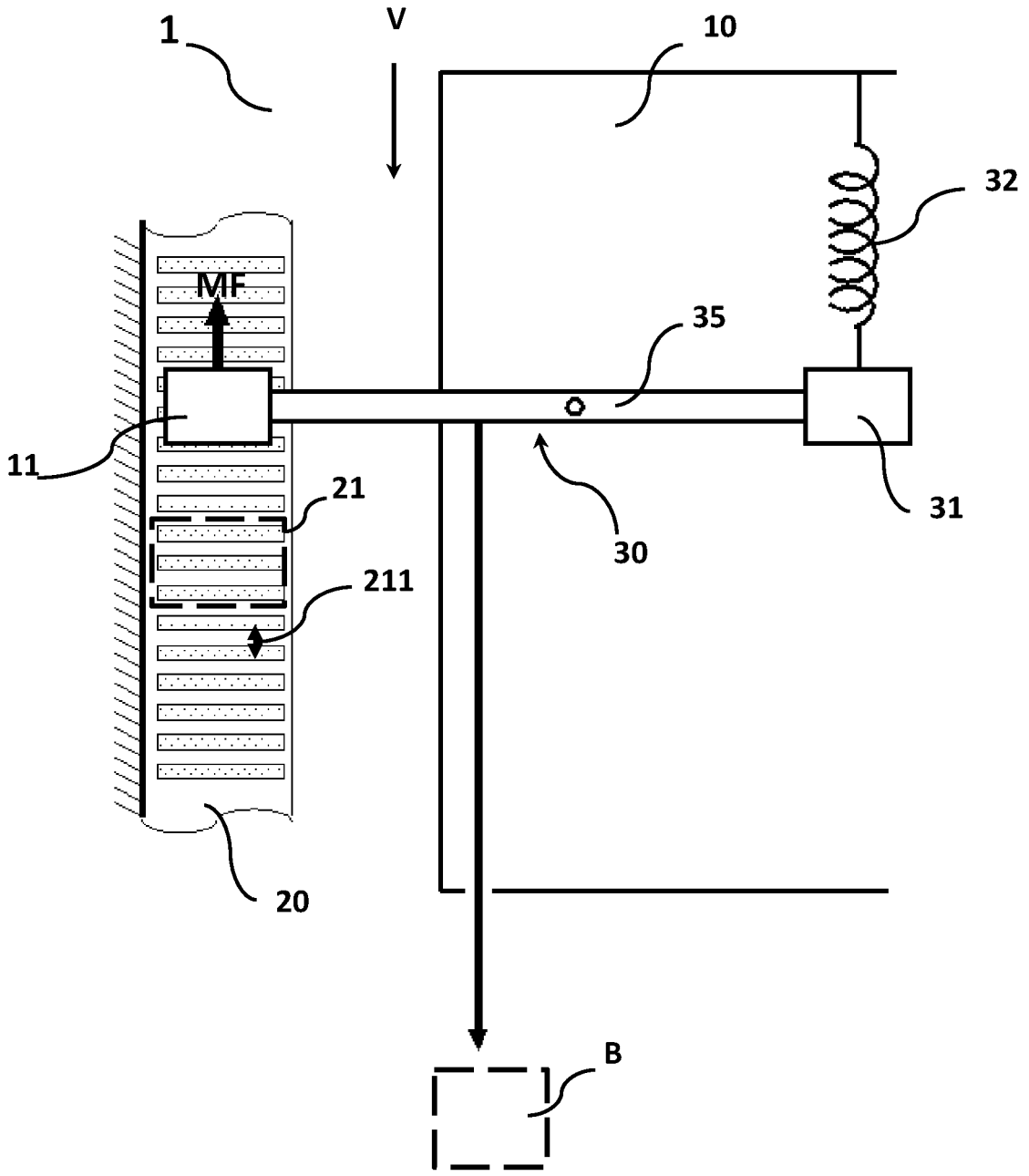
FIG. 5 shows a schematic view of the overspeed emergency brake system with resonant characteristic components for another embodiment of the invention.
Figure 6:
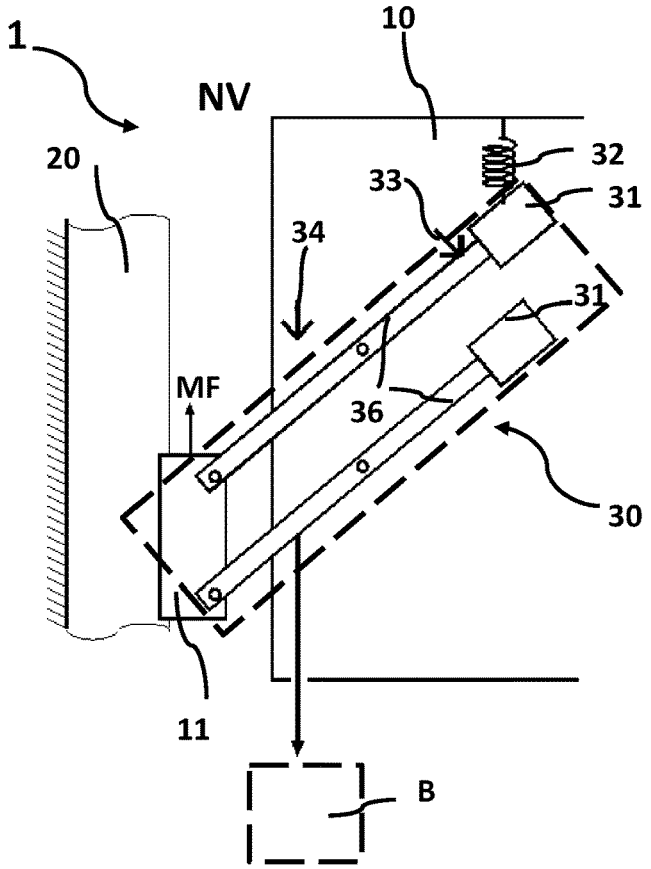
FIG. 6 shows a schematic view of the overspeed emergency brake system in another embodiment in operational velocity.
Figure 7:
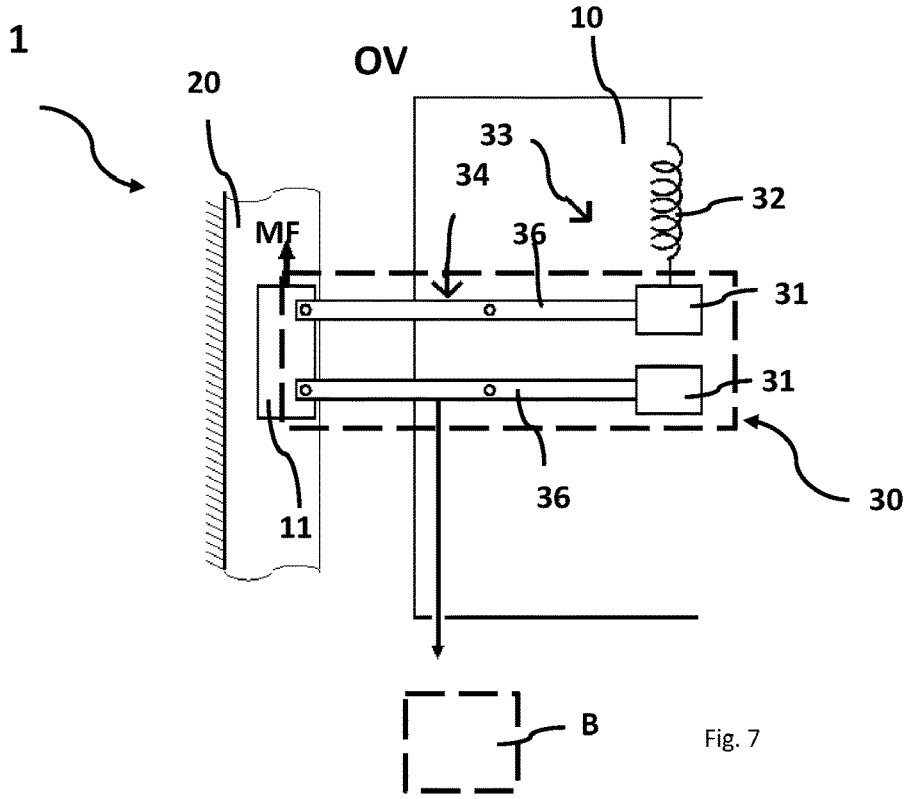
FIG. 7 shows a schematic view of the overspeed emergency brake system in the embodiment of FIG. 6 in overspeed operation.

The second main embodiment of the invention is depicted below:

The system comprises a kinematic constraint element (30) having a pivot arm (35). In this embodiment, pivot arm (35) is fixed to the overspeed detector magnet (11) at one end and fixed to the controlling element (32) at the other end. The end of the controlling element (32) which is not connected to the kinematic constraint element (30) is fixed to the elevator car (10) when the system (1) installation to the elevator car (10) is made. In this embodiment, the kinematic constraint element (30) comprises a counterweight (31) for countering the weight of the overspeed detector magnet (11) which serves to prevent acceleration forces from moving the overspeed detector magnet (11). The controlling element (32) is attached in such a way that the overspeed detector magnet (11) overlaps the periodic feature (21) on the reaction surface (20) during normal operation velocity and is able to make oscillatory motion along the direction of motion of elevator car (10). Pivot arm (35) is connected with a suitable linkage having a specific mechanical advantage, to the trigger mechanism of the overspeed emergency brake (B), which is in turn, attached to the elevator car (10) (FIG. 5).

In this embodiment, the reaction surface (20) comprises at least one periodic feature (21). The periodic feature (21) comprises slits, or horizontal slits, or parallel horizontal slits, or non-straight edge along its length. Or the periodic feature (21) comprises similar periodic deviations from a straight line or smooth surface or homogeneous composition, along its length. Reaction surface (20) also comprises at least one pitch (211) which defines the repetition distance of the periodic feature (21).

In this embodiment, during movement of the elevator car (10), the force on the overspeed detector magnet (11) is modulated by the periodic features (21) at a certain frequency which is related to periodic feature pitch (211) and elevator car (10) velocity. The mechanical properties of the kinematic constraint element (30), the controlling element (32) and the magnet (11) is such that their resonance frequency coincides with the specific frequency which is produced by the elevator car (10) running at the desired overspeed velocity value. At the predefined overspeed velocity of the elevator car (10), therefore, the kinematic constraint element (30) will start to resonate at large amplitude, trigger the overspeed emergency brake (B) and arrest the movement of the elevator car (10). During normal operation the resonance does not occur and the overspeed emergency brake is not triggered.

This embodiment is also advantageous compared to previous prior art, because it can be tuned to the specific overspeed velocity by modifying the dimensions of the deviations, the characteristics of the mechanical components, such as the moment of inertia of the kinematic constraint element (30) and/or spring constant of the controlling element (32) and/or pitch (211) etc.

The brake system (1) proposed in the invention, is better in both of these areas, where the force generated at normal operating range is smaller than the prior art applications, which means better power efficiency. Second, elevator car (10) velocity-system force response is nonlinear at overspeed condition. Therefore, by designing the mechanical components properly, it is possible to set a precise triggering velocity for the overspeed limit.

Overspeed emergency brake system (1) enables an elevator car (10) (eg: a passenger elevator) overspeed emergency brake (B) system which is completely contained within the elevator car (10) itself. The advantages of the invention are:

- Overspeed detection based on magnetic principles is provided thereby making the invention self contained in the elevator car (10).
- Completely mechanical overspeed emergency detection and brake activation is provided.

Suitable for use in multi-car elevator systems.

It provides higher efficiency. This mechanism does not produce a force proportional to elevator car (10) velocity.

It provides, precise setting of overspeed emergency limit of velocity of the elevator car (10).

The system (1) does not require special maintenance.

It provides low implementation cost.

It is simple to implement.

In the system, calibration is necessary only at the factory for initial settings.

The invention is not limited to the disclosed embodiments above; a skilled person in the art can produce different embodiments of the invention easily. They should be evaluated within the scope of protection demanded with claims.

What is claimed is:

1. An overspeed emergency brake system for transporting elevator cars comprising: an overspeed detector magnet generating a brake actuation force, a reaction surface, and a kinematic constraint element guiding a movement of the overspeed detector magnet;

the kinematic constraint element is attached to the elevator car for defining the motion of the magnet with respect to the elevator car and the reaction surface;

wherein the overspeed detector magnet, the reaction surface, and the kinematic constraint element are arranged such that a linear brake actuation force is generated at a normal operating speed condition due to a movement of the kinematic constraint element when guiding the overspeed detector magnet along the reaction surface, where the overspeed detector magnet only partially overlaps the reaction surface, which causes an opposing force on the overspeed detector magnet when the elevator car is in a normal operation speed condition resulting a linear speed-force relationship between the magnet and reaction surface, and the kinematic constraint element converts the linear speed-force relationship into a nonlinear speed-force relationship between the magnet and reaction surface during an overspeed condition by increasing an overlap area between the overspeed detector magnet and the reaction surface thereby sharply increasing magnetic force generated on the overspeed detector magnet due to the increasing of the overlap area.

2. The overspeed emergency brake system for transporting elevator cars according to claim 1, further comprising a controlling element to provide a constant force to keep the overspeed detector magnet in a stable position of the kinematic constraint element until a desired counter-force of sufficient magnitude occurs wherein the kinematic constraint element defines a motion trajectory of the overspeed detector magnet, wherein the controlling element applies a pre-tension force to hold the overspeed detector magnet towards a retracted limiting element in the normal operating speed condition, and in case of an overspeed condition where a transition region defined by the magnetic force overcoming the pre-determined holding force of the controlling element is reached and causes the overspeed detector magnet to start translating across the reaction surface due to the kinematic constraint element thereby triggering the overspeed emergency brake at a pre-determined overspeed velocity limit, when overspeed limit is exceeded the transition region ends, a maximum brake force and a displacement of the overspeed detector magnet is generated whereby the surface of the overspeed detector magnet completely overlaps the reaction surface and the overspeed detector magnet is restrained by an extended limiting element.

3. The overspeed emergency brake system for transporting elevator cars according to claim 2, wherein the kinematic constraint element is fixed to the overspeed detector magnet at a first end and fixed to the controlling element at a second end.

4. The overspeed emergency brake system for transporting elevator cars according to claim 2, wherein the kinematic constraint element is a pivot arm.

5. The overspeed emergency brake system for transporting elevator cars according to claim 2, wherein the kinematic constraint element comprises a parallel link or at least two parallel mechanical arms.

6. The overspeed emergency brake system for transporting elevator cars according to claim 5, wherein the kinematic constraint element and the overspeed detector magnet are arranged such that the overspeed detector magnet remains parallel to the reaction surface on two mechanical arms during translation when the overspeed emergency brake system is operating.

7. The overspeed emergency brake system for transporting elevator cars according to claim 2, wherein the kinematic constraint element consists of at least one linear guide or multitude of parallel guides.

8. The overspeed emergency brake system for transporting elevator cars according to claim 7, wherein the overspeed detector magnet, the kinematic constraint element, and controlling element are arranged such that overspeed detector magnet translates on a multitude of slanted parallel linear guides and one movement limit end of the linear guides forms the retracted limiting element, and the other end is the extended limiting element; wherein, the overspeed detector magnet is held towards the retracted limiting element with a suitable pre-tension using the controlling element, where the surface of the overspeed detector magnet partially overlaps with the reaction surface at the first position.

9. The overspeed emergency brake system for transporting elevator cars according to claim 2, wherein the controlling element is a spring of linear or rotational design or a device which generates larger force or constant force as the device extends.

10. The overspeed emergency brake system for transporting elevator cars according to claim 1, further comprising a controlling element to provide a constant force to keep the overspeed detector magnet in a stable position of the kinematic constraint element until a desired counter-force of sufficient magnitude occurs wherein the kinematic constraint element and the overspeed detector magnet are arranged such that a resonance frequency of the overspeed detector magnet and the kinematic constraint element coincides with a specific frequency to be produced by the elevator car running at the predefined overspeed velocity value, causing the kinematic constraint element, controlling element and the overspeed detector magnet to resonate at a larger amplitude than a normal operation speed to trigger the overspeed emergency brake and arrest a movement of the elevator car, wherein during the normal operation speed the resonance does not occur and the overspeed emergency brake is not being triggered.

11. The overspeed emergency brake system for transporting elevator cars according to claim 10, wherein the kinematic constraint element comprises a pivot arm for connecting with a suitable linkage having a specific mechanical advantage, to a trigger mechanism of the overspeed emergency brake.

12. The overspeed emergency brake system for transporting elevator cars according to claim 11, wherein the kinematic constraint element comprises the controlling element defining the motion trajectory of the overspeed detector magnet.

13. The overspeed emergency brake system for transporting elevator cars according to claim 11, wherein the pivot arm is fixed to the overspeed detector magnet at one end and fixed to the controlling element at an other end.

14. The overspeed emergency brake system for transporting elevator cars according to claim 10, wherein the reaction surface has at least one periodic feature, arranged in such a way that the overspeed detector magnet is able to overlap with the periodic feature on the reaction surface during the normal operation velocity and is able to make an oscillatory motion along a direction of motion of the elevator car and the mechanical nonlinearity is achieved by modulating the brake actuation force with the periodic feature.

15. The overspeed emergency brake system for transporting elevator cars according to claim 14, wherein the periodic feature comprises slits, or periodically placed slots or horizontal slits, or parallel horizontal slits, or non-straight edge along a length of the periodic feature.

16. The overspeed emergency brake system for transporting elevator cars according to claim 14, wherein the periodic feature comprises periodic deviations from a straight line or smooth surface or homogeneous composition, along a length of the periodic feature.

17. The overspeed emergency brake system for transporting elevator cars according to claim 14, wherein the reaction surface further comprises at least one pitch which defines a repetition distance of the periodic feature for modulating a force on the overspeed detector magnet at a certain frequency during movement of the elevator car.

18. The overspeed emergency brake system for transporting elevator cars according to claim 10, further comprising a counterweight for countering a weight of the overspeed detector magnet to prevent acceleration forces from moving the overspeed detector magnet.

19. The overspeed emergency brake system for transporting elevator cars according to claim 1, further comprising a counterweight for countering a weight of the overspeed detector magnet to prevent acceleration forces from moving the overspeed detector magnet.

* * * * *